United States Patent [19]

Vigouroux et al.

[11] Patent Number: 4,553,600

[45] Date of Patent: Nov. 19, 1985

[54] SAFETY INSTALLATION FOR A SUBMERGED DRILLING WELL-HEAD

[75] Inventors: Georges Vigouroux, Carrieres; Gilbert Fort, Paris; Louis Soleille, Les Clayes-sous-bois, all of France

[73] Assignee: Compagnie Francaise des Petroles, Paris, France

[21] Appl. No.: 572,047

[22] Filed: Jan. 19, 1984

[30] Foreign Application Priority Data

Jan. 26, 1983 [FR] France ..... 83 01142

[51] Int. Cl.[4] ..... E21B 29/08; E21B 43/01

[52] U.S. Cl. ..... 166/343; 166/339; 166/363

[58] Field of Search ..... 166/338, 339, 344, 347, 166/361, 363, 364, 368, 343; 405/169, 158

[56] References Cited

U.S. PATENT DOCUMENTS 4,046,191 9/1977 Neath ..... 166/364

4,095,421 6/1978 Silcox ..... 166/344

4,386,659 6/1983 Shotbolt ..... 405/169

4,442,902 4/1984 Doremus et al. ..... 166/343

4,461,354 7/1984 Buras et al. ..... 166/343

*Primary Examiner*—Stephen J. Novosad

*Assistant Examiner*—Bruce M. Kisliuk

*Attorney, Agent, or Firm*—Sughrue, Mion, Zinn, Macpeak and Seas

[57] ABSTRACT

A safety installation for a well-head located on the sea bottom comprises an emergency unit mounted on the well-head below the well shut-off units and including a complete-closure shut-off device controlled by sound transmission and by an intervention liquid supplied to a lateral inflow, a re-entry structure provided with an inflow funnel and placed on the sea bottom in the region of the well-head but spaced therefrom, and a flexible pipe connecting the lateral inflow of the emergency unit to the re-entry structure for intervention liquid and being wound on a drum on the re-entry structure.

6 Claims, 10 Drawing Figures

SAFETY INSTALLATION FOR A SUBMERGED DRILLING WELL-HEAD

BACKGROUND OF THE INVENTION

The present invention relates to means for the protection of personnel, equipment and the environment in the event of a blow-out during the drilling of a submerged well. It relates more particularly, but not exclusively to drilling carried out from a floating support on a very deep stretch of water, where intervention by means of underwater equipment is out of the question. It is necessary, under these circumstances, to provide a safety installation which can be activated rapidly and reliably from the floating drilling support in the event of failure of the conventional protective means, such as the units for shutting off the well or their control means.

SUMMARY OF THE INVENTION

According to the invention there is provided a safety installation for a submerged well-head incorporating at least one well shut-off unit located above a tubing receptacle, the safety installation comprising an emergency unit comprising a well shut-off means and an injection pipe for opening into the well-head between the well shut-off unit and the tubing receptacle and connected to a lateral fluid inflow for an intervention fluid intended for the well shut-off means and for the injection pipe, a re-entry structure which is intended to be located on the bottom of the water at a distance from the well-head and which is provided with the first inflow funnel for receiving externally an intervention-fluid supply fitting, and a flexible pipe for connection by its first end to the first inflow funnel and by its second end to the lateral inflow.

This installation may be operated from, and by the displacement of, a floating support, and by the descent of a fitting and its connection to the re-entry structure, the location of which has preferably been selected to be sufficiently distant, for example approximately 200 meters, from the well-head and upstream of the latter in the direction of the dominant currents prevailing in the stretch of water, so that it is not disturbed in the event of a blow-out of the well.

The lateral inflow is preferably connected in the emergency unit by a first connection to means for controlling the shut-off means, and by a second connection to the injection pipe, calibrated closing means ensuring the opening of the second connection at an interventionfluid pressure greater than a pressure threshhold below which the first connection is already open.

The emergency unit may include at least one hydraulic accumulator connected to means for controlling the shut-off means by a valve controlled by a sound transmission from the surface.

To ensure greater safety, the emergency unit is preferably welded to the tubing receptacle. The emergency unit preferably consists of components welded to one another without any joint which risks causing leaks.

The re-entry structure preferably comprises a winch with a winding drum for the flexible pipe, a revolving joint located on the pivot of the drum for providing a connection between the first inflow funnel and the first end of the flexible pipe, a second inflow funnel attached to the second end of the flexible pipe and for engagement by a gripping and displacement tool, and a housing for temporarily receiving the second end, the lateral inflow and the second end being provided with complementary connection components forming an automatic connector.

The re-entry structure may include a hydraulic motor for driving the drum in the direction to wind up the flexible pipe, and a third inflow funnel connected internally to the hydraulic motor and designed to receive externally a handling fitting.

BRIEF DESCRIPTION OF THE DRAWINGS

An embodiment of the invention will now be described, by way of example only, with reference to the accompanying drawings.

In the drawings.

DETAILED DESCRIPTION OF THE PREFERRED EMBODIMENTS

Figure 1:
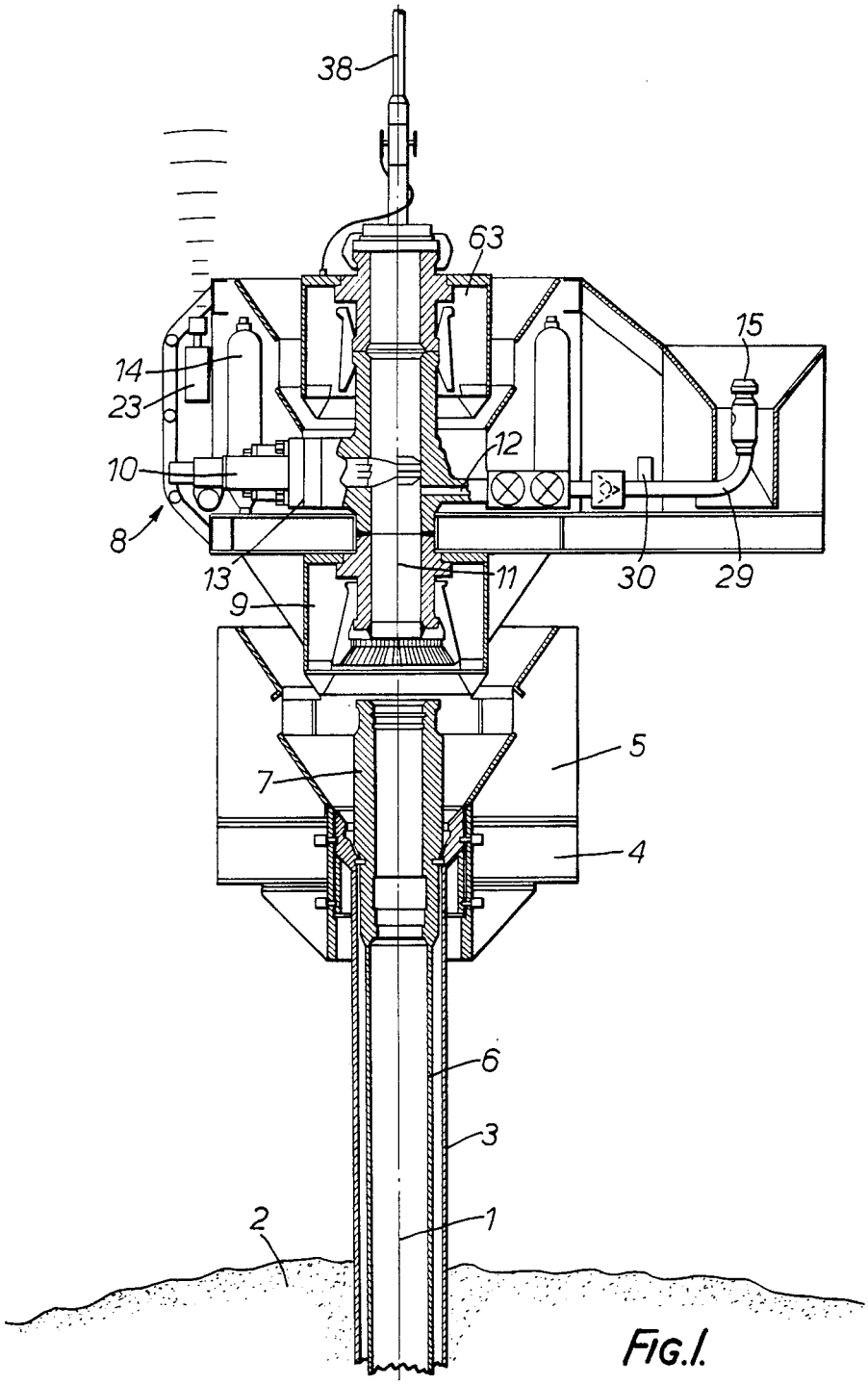
FIG. 1 is a view in elevation and partial section of an embodiment of an emergency unit of a safety installation according to the invention, and the tubing receptacle which receives the emergency unit.
Figure 2:
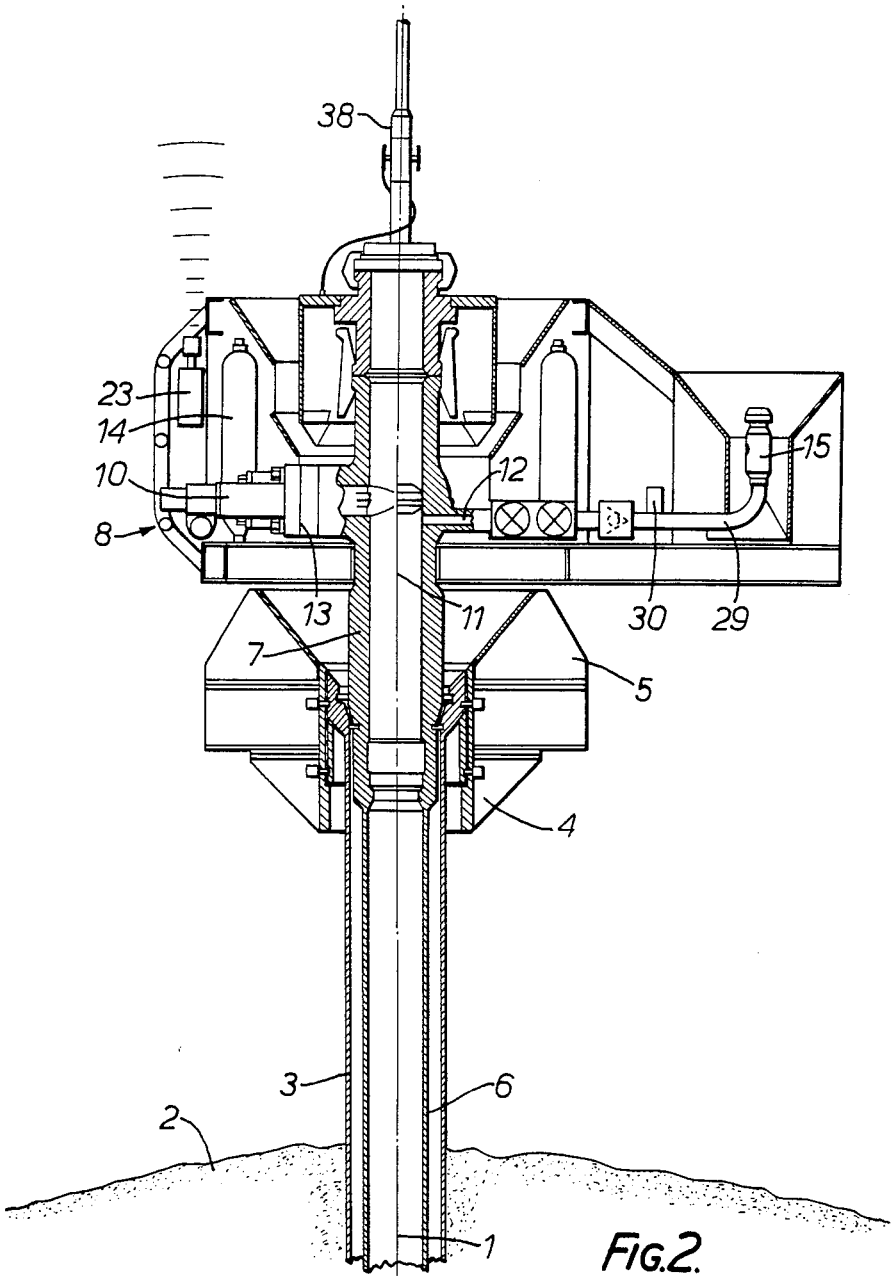
FIG. 2 is a view similar to that of FIG. 1, where the emergency unit and the tubing receptacle form a welded assembly.

In FIGS. 1 and 2, a well 1 being drilled in the sea bottom 2 is provided with a first casing 3, which carries at its upper end a base plate 4 and a reentry cone 5, and a second casing 6 having a diameter less than that of the first casing and provided at its upper end with a tubing receptacle 7.

An emergency unit 8 forming part of a safety installation is mounted on the tubing receptacle 7. In the embodiment of FIG. 1, the unit 8 is mounted on receptacle 7 by a connector 9, but in the embodiment of FIG. 2 the unit 8 is welded to the receptacle 7 and lowered onto the well at the same time as the casing 6.

The emergency unit 8 comprises a shut-off device 10 with a drill rod-cutting jaw, which is intended, in the event of failure of the conventional means of protection, to completely shut-off the central axial passage 11 provided in the unit, and an injection pipe 12 opening into the central passage 11 below the shut-off device 10 to inject into the well 1 a blow-out stopping liquid, such as mud or cement.

Figure 3:
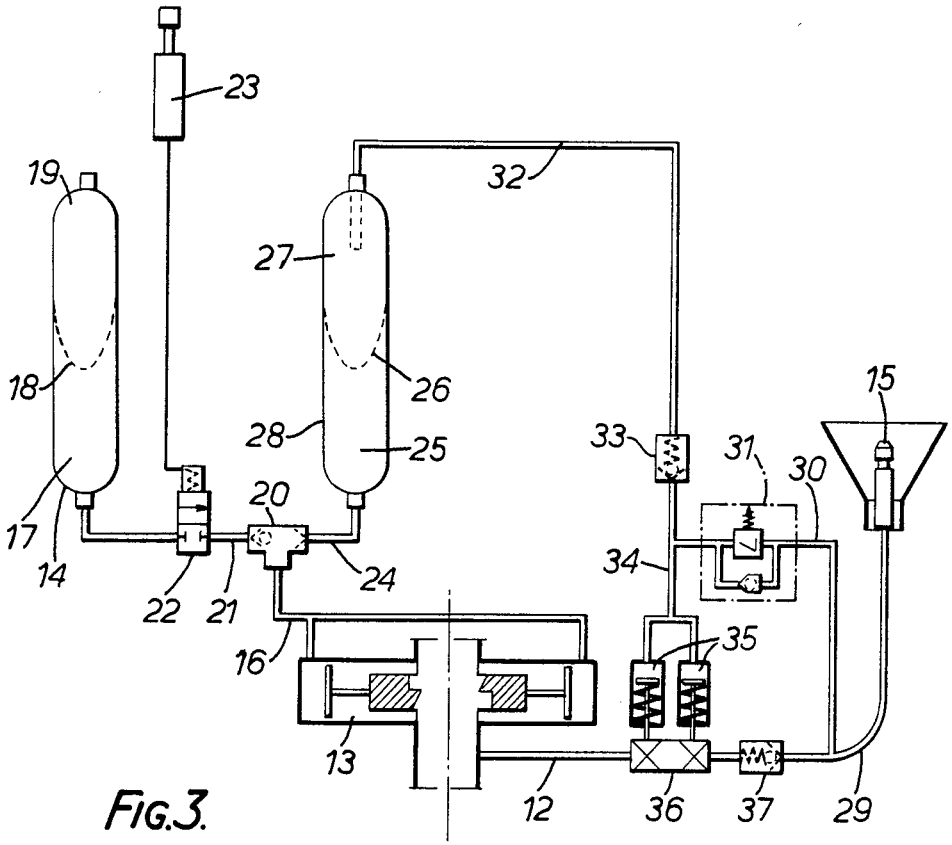
FIG. 3 is a diagrammatic illustration of certain hydraulic connections within the emergency unit.

The shut-off device 10 is closed by the action of a hydraulic jack 13, which can be actuated in either of two ways, as shown in FIG. 3. As shown in FIG. 3, the jack can be actuated either from an oil-pneumatic accumulator or a battery of oil-pneumatic accumulators 14 located in the emergency unit 8 and charged beforehand on the surface, or from a lateral intervention-fluid inflow 15. All the hydraulic connections are preferably welded.

The jack 13 is connected hydraulically by means of pipe 16 to a first hydraulic chamber 17 of the accumulator or accumulators 14, the or each chamber 17 is filled with oil and is separated by an impermeable diaphragm 18 from a second pressurised-gas chamber 19 of the accumulator. A circuit selector 20 operating according to pressure connects the pipe 16 to a pipe 21 communicating with the chamber 17 and incorporating a solenoid valve 22 controlled by a hydrophone 23 which itself receives instructions in the form of coded sound waves.

This pipe 16 is also connected by the circuit selector 20 to pipe 24 communicating with a first oil-filled chamber 25, separated by an impermeable diaphragm 26 from a second chamber 27, of an energy transfer bottle 28, the chamber 27 of which is connected to the lateral inflow 15 by pipe 29 which is connected to inflow 15 and to pipe 30 which is provided with a pressure reducer 31 of adjustable calibration with a built-in non-return valve and connected to pipe 32 provided with a calibrated valve 33 and which opens into the chamber 27. the pipe 30 is also connected to a pipe 34 which feeds actuators 35 of valves 36 arranged together with a calibrated non-return valve 37 between the injection pipe 12 and the pipe 29. The valves 36 open at a pressure well above the calibration pressure of the pressure reducer 31. The valves 36 open at a pressure below the calibration pressure of the valve 37 and close when the pressure drops in the pipe 30. Valves 33, 37 and pressure reducer 31 may be replaced by a differential-pressure regulator which could impose a sequential supply of intervention fluid to the bottle 28, then to the valve actuators and subsequently to the injection pipe 12, whilst ensuring that the valves 36 close as a result of a lack of pressure.

As will be seen later, the lateral inflow 15 is connected to a flexible pipe fed with intervention liquid in the event of a blow-out, but filled with water when inactive, so that the pipe 30 first receives only water and not mud or cement, whilst the injection pipe 12 receives water and then mud or cement.

FIGS. 1 and 2 show the end of a string of rods 38 for lowering the unit 8, or the assembly consisting of the units 8 and the casing 6, onto the well 1.

Figure 4:
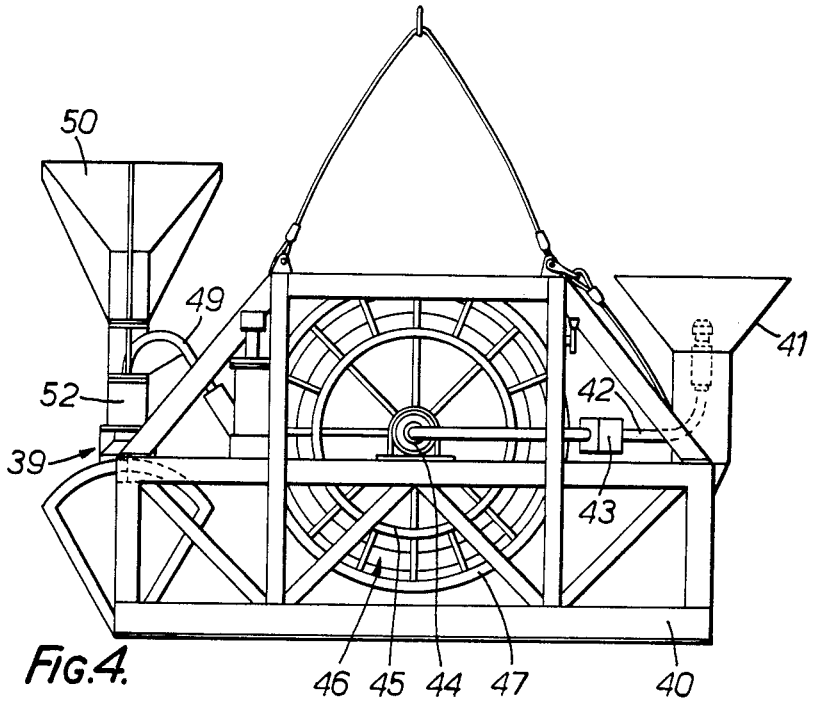
FIG. 4 is a view in elevation of an embodiment of a re-entry structure of a safety installation according to the present invention.
Figure 5:
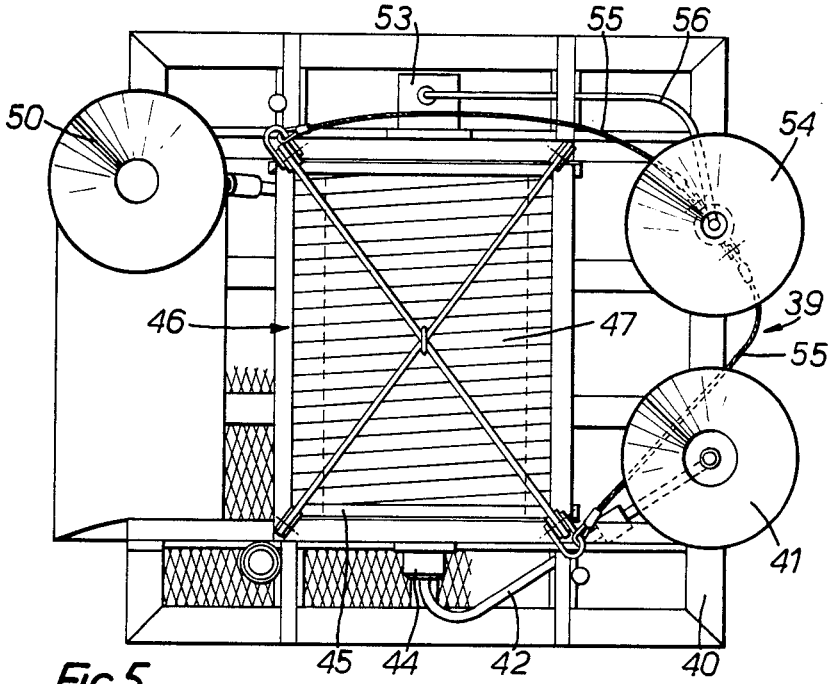
FIG. 5 is a plan view of the structure of FIG. 4.

FIGS. 4 and 5 show a re-entry structure 39 comprising a framework 40 which carries a first inflow funnel 41 connected to a pipe 42 provided with a non-return valve 43 and ending in the fixed part of a revolving joint 44 mounted on the pivot of a drum 45 of a winch 46. A flexible pipe 47 is wound on the drum and is connected at a first end, which cannot be seen in FIGS. 4 and 5, to the rotary part of the revolving joint 44 and is connected at its second free end 49 mechanically to a second inflow funnel 50 and hydraulically to the female part 51 (not shown in FIGS. 4 and 5) of a hydraulic connector, the complementary male part of which consists of the lateral inflow 15 of the emergency unit 8. The female part 51 of the connector, which can be seen in FIG. 7, rests temporarily on a housing 52 carried by the framework 40, as can be seen in FIG. 4. The drum 45 can be driven in rotation by a hydraulic motor 53 which can be seen in FIG. 5.

As can be seen in FIG. 5, the framework 40 carries a third funnel 54 which is retained on the framework by shear pins, is attached to slings 55 and has a hydraulic connector (not shown) connected by a flexible pipe 56 to the hydraulic motor 53. Thus, it is possible by means of a handling fitting both to raise the re-entry structure 39 and to actuate the hydraulic motor 53 so as to wind the flexible pipe 47 onto the drum 40.

It will now be explained how the re-entry structure and the flexible pipe can be put in position.

Figure 6:
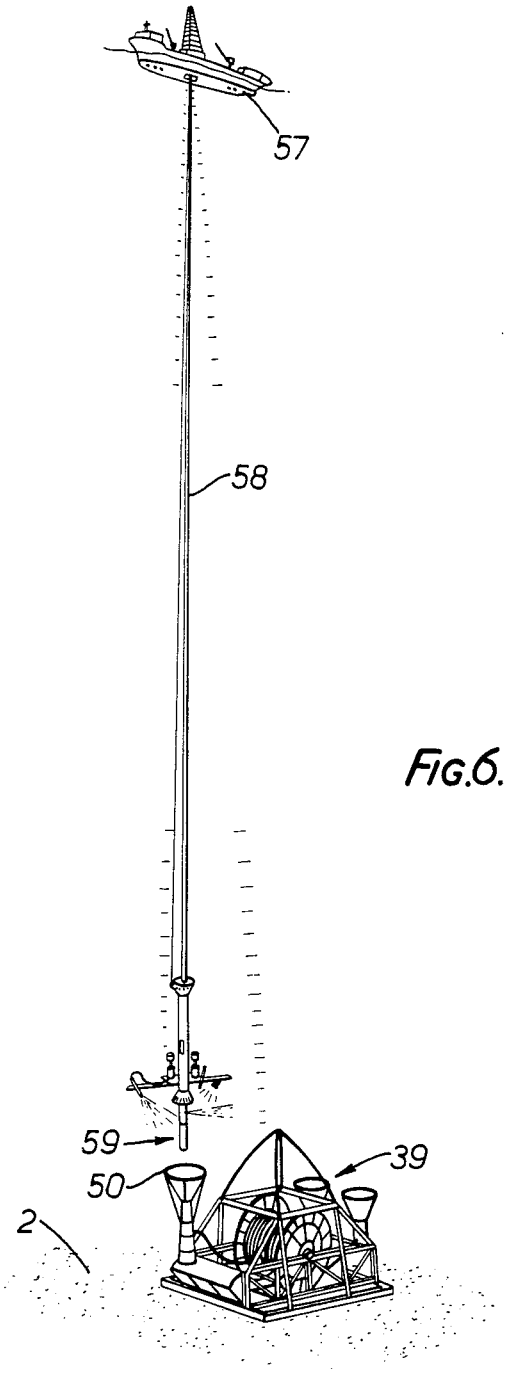
FIG. 6 shows in perspective the re-entry structure located on the bottom of the water together with a floating support and a string of rods provided with a gripping tool for engaging the flexible pipe of the reentry structure.

The re-entry structure 39 is lowered, together with the flexible pipe 47 wound on the drum 5, by means of a string of rods (not shown) so as to place it on the sea bottom 2 at the selected location (FIG. 6). When the structure 39 has been placed on the sea bottom 2, as can be seen in FIG. 6, a string of rods 58, carrying at its lower end a mechanical connector 59 designed to engage with the second inflow funnel 50, is lowered from a drilling ship 57. The string of rods 58 is complete with conventional positioning means, such as a supporting guide for re-entry, responder beacons, television cameras, a short connection with lateral perforations enabling the string of rods to be directed by a lateral reaction effect, a fluid under pressure being circulated in the rods of this string of rods, and an inclinometer.

Figure 7:
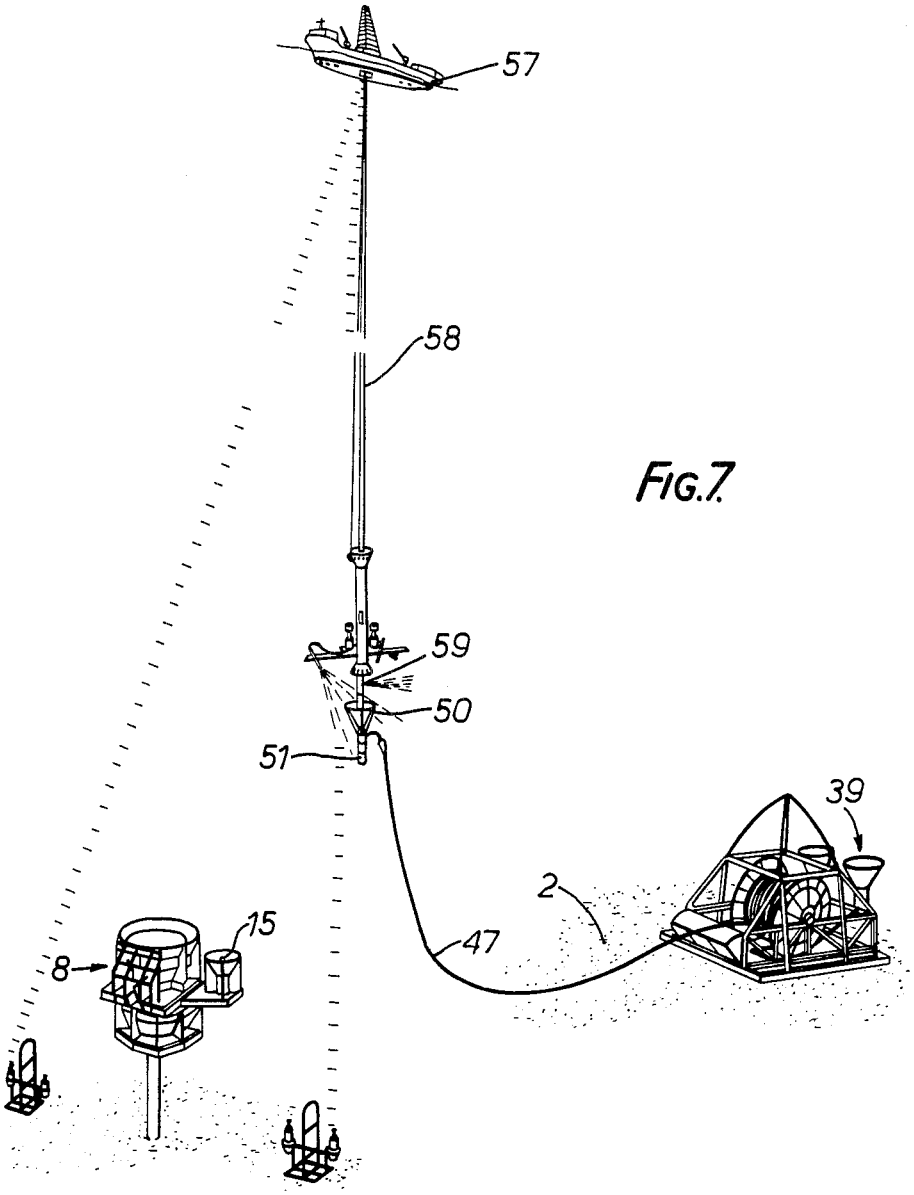
FIG. 7 shows in perspective the entire safety installation during the time when the end of the flexible pipe is brought towards the emergency unit.

After the connector 59 has been engaged with the second inflow funnel 50, the string of rods 58 is raised a little and the ship 57 is then advanced towards a point vertically above the emergency unit 8 (FIG. 7), whilst the flexible pipe 47 gradually unwinds. The string of rods 58 is gradually lowered again during this displacement, in order to place the flexible pipe 47 on the sea bottom 2, as shown in FIG. 7. When the string of rods 58 is vertically above the emergency unit 8, the female part 51 is coupled to the lateral inflow 15, the two connector parts being locked automatically using a known connection system permitting unlocking to be achieved at the end of drilling by a known method, such as relative rotation, the release of a ball or the transmission of compressed fluid, depending on the type of connector chosen.

Figure 8:
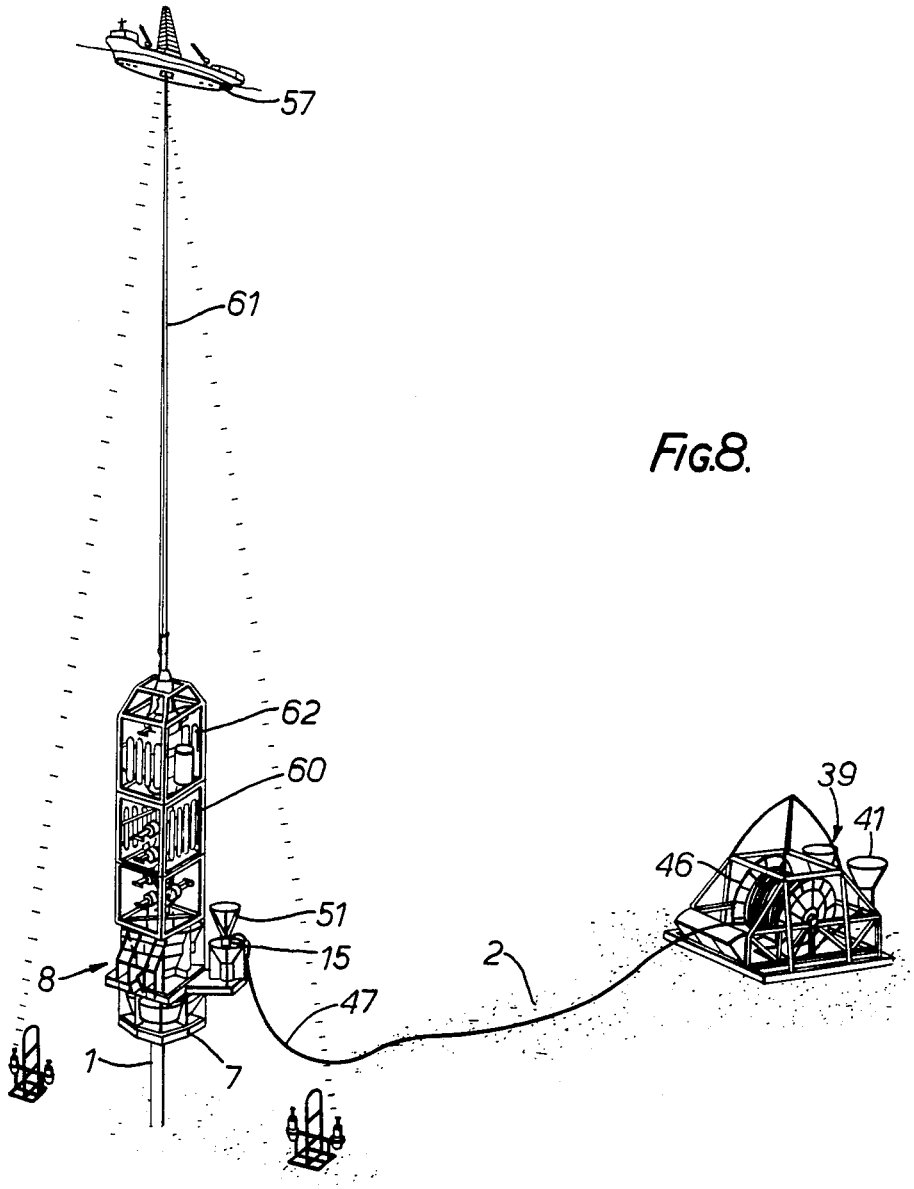
FIG. 8 is a view in perspective of the safety installation during drilling.

The string of rods 58 is subsequently raised to the surface, and the safety installation is then ready to be operated. FIG. 8 shows the whole of the installation, after the conventional well shut-off units 60 have been lowered onto the emergency unit 8 and after a connection has been made with the ship 57 by means of an extension tube called a riser 61 and a lower extension-tube assembly 62. The well shut-off units 60 are connected to the emergency unit 8 by a connector which has not been shown because it is of a conventional type identical to the handling connectors 63 shown in FIG. 1 at the bottom of the string of rods 38.

The procedure for putting the safety installation into position and into operation which has just been described can of course be modified. It would be possible, for example, to lower the emergency unit 8 and the re-entry structure 39 to the bottom simultaneously, the connector parts 15 and 51 having previously been engaged and locked on the surface. In this case, the re-entry structure 39 would subsequently be displaced under water to bring it into the desired position on the sea bottom, whilst the flexible pipe 47 would be unwound gradually as in the procedure described above.

Another procedure would involve lowering the structure 39 at the end of a string of rods and connecting the female connector part 51 to the male part of the lateral inflow 15 of the emergency unit 8 which would have previously been lowered. The structure 39 would subsequently be displaced under water, as in the preceding case, so as to unwind and place on the bottom 2 the flexible pipe 47 and place the structure 39 on the bottom 2.

If a blow-out occurs and the well shut-off units 60 break down, the shut-off device 10 is first closed by means of a special sound control system designed to control the hydrophone 23.

Figure 9:
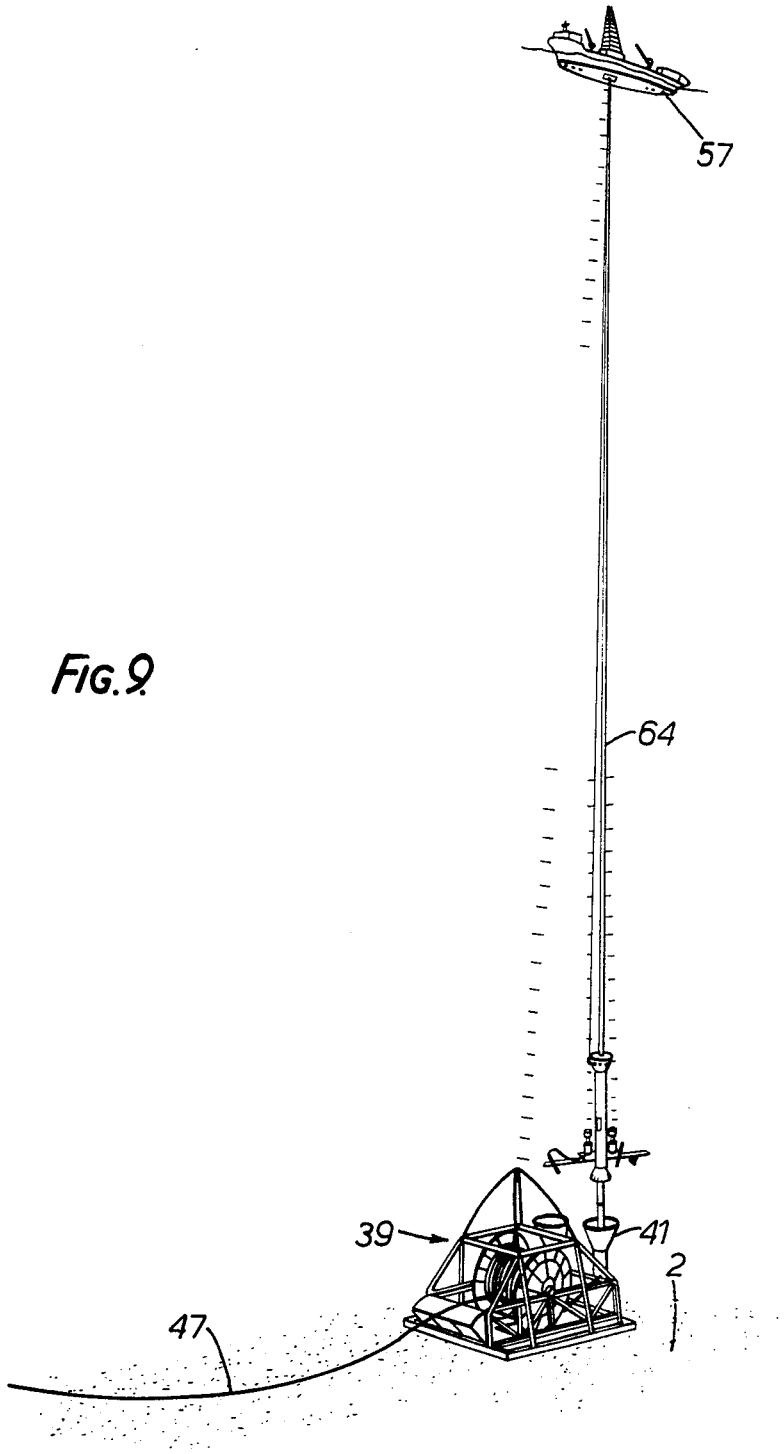
FIG. 9 is a view in perspective of the reentry structure during the supply of intervention fluid.

If this control is itself defective and/or if the well is to be killed, a supply fitting 64 is lowered onto the first inflow funnel 41 as shown on FIG. 9, enabling introduction of a liquid under pressure, such as mud or cement. The lower end of the supply fitting 64 carries a connector part complementary to another connector part mounted in the funnel 41, the connector formed in this way having automatic locking and unlocking controlled by a known method.

Supplying a liquid under pressure, such as heavy mud or cement, to the fitting 64 first causes the transmission to the jack 13 of sufficient pressure to close the shut-off device 10, and subsequently, when the pressure exceeds the fixed threshholds at the opening of the valve 37 and the valves 36, causes the injection into the well of the water contained in the flexible pipe 47 and the fitting 64 and then of mud or cement.

Figure 10:
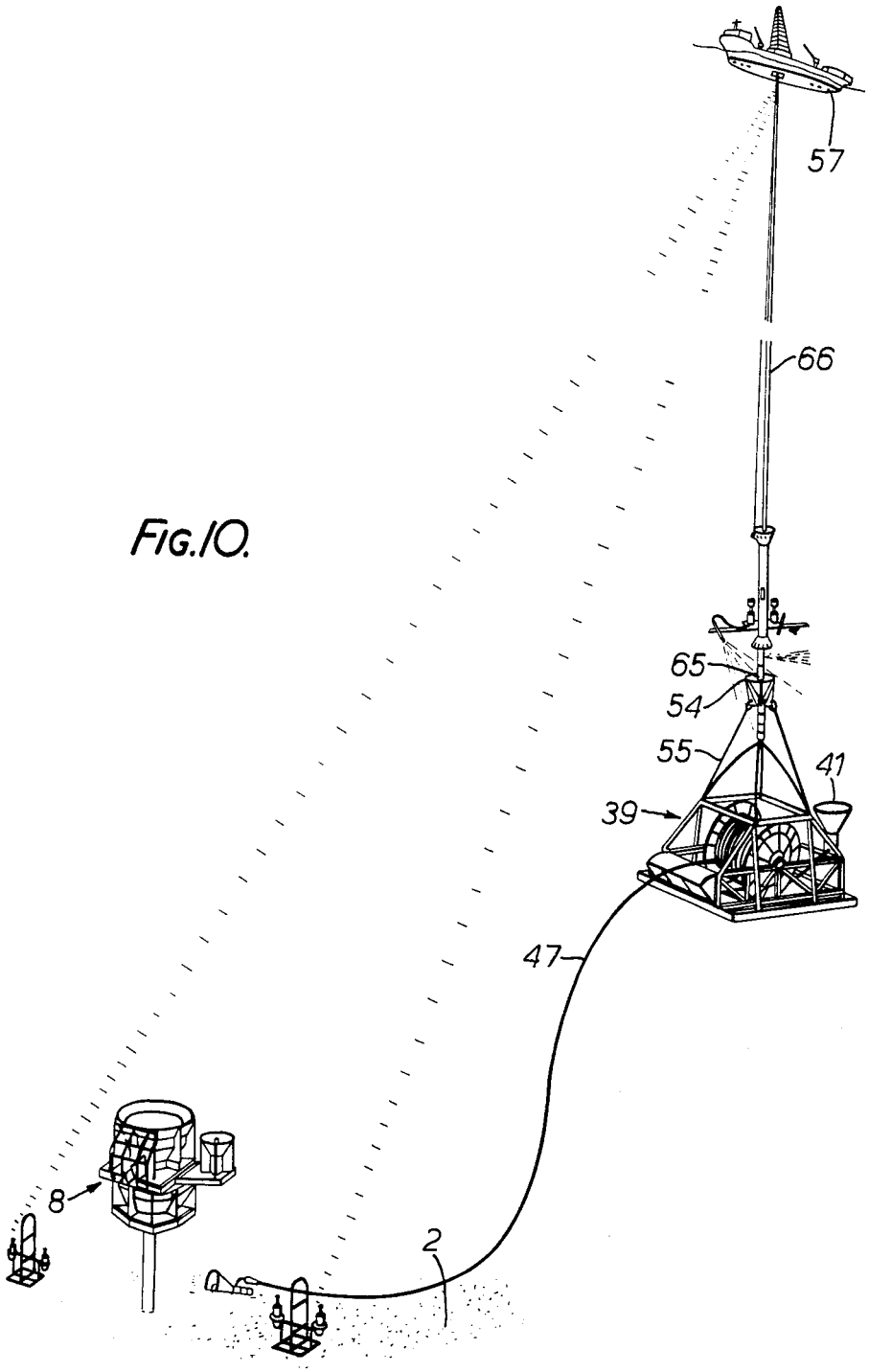
FIG. 10 is a view in perspective of the reentry structure during its ascent to the surface at the end of drilling.

When drilling is concluded, the connection between the lateral inflow 15 and the female part 51 is unlocked, and the connector 65 of a handling fitting 66 is introduced into the third funnel 54 of the re-entry structure. The connector is automatically locked to the funnel 54, and a pull can then be exerted on the fitting 66 to shear the pins retaining the funnel 54 on the framework 40, so that the fitting 66 subsequently pulls on the re-entry structure 39 by means of the slings 55, as shown in FIG. 10. During the ascent of the re-entry structure 39 to the surface, a fluid under pressure is conveyed into the fitting 66 to actuate the hydraulic motor 53 to wind the flexible pipe 47 onto the drum 45.

It will be understood that numerous modifications can be made to the equipment and procedure described, without departing from the scope of the invention.

What is claimed is:

1. A safety installation for a submerged wellhead incorporating at least one well shut-off unit (60) located above a tubing receptacle (7), said safety installation comprising an emergency unit (8) comprising a well shut-off means (10), an injection pipe (12) for opening into the well-head between the well shut-off unit and the tubing receptacle, a lateral fluid inflow (15) for an intervention fluid for said well shut-off means and for said injection pipe, and means (29, 37, 36) connecting said lateral fluid inflow to said injection pipe, a re-entry structure (39) disposed on the sea bottom (2) at a horizontal distance from said well-head and provided with a first inflow funnel (41) for receiving externally an intervention fluid supply fitting (64), and a flexible pipe (47) having a first end and a second end and for connection by its said first end to said first inflow funnel and by its said second end to said lateral fluid inflow, whereby upon the failure of the shut-off unit flowing a blowout, intervention fluid may be supplied to the re-entry structure from a surface location horizontally removed from the well-head to actuate the shut-off means and inject the well-head via the pipe.

2. An installation according to claim 1, wherein, in the emergency unit, said lateral fluid inflow is connected by a first connection (30, 32) to means (28, 20, 13) for controlling said shut-off means, and by a second connection to said injection pipe, and further comprising calibrated closing means (31, 33, 37) for ensuring the opening of said second connection at an intervention-fluid pressure greater than a pressure threshold below which said first connection is already open.

3. An installation according to claim 2, wherein said emergency unit comprises at least one hydraulic accumulator (14) connected to means for controlling said shut-off means by way of a valve (22) controlled by sound transmission.

4. An installation according to claim 1, wherein said emergency unit is welded to said tubing receptacle.

5. An installation according to claim 1, wherein said re-entry structure comprises a winch (46) with a winding drum (45) for said flexible pipe, a revolving joint (44) located on a pivot of said drum and providing connection between said first inflow funnel and said first end of said flexible pipe, a second inflow funnel (50) connected to said second end of said flexible pipe and for engagement by a gripping and displacement tool (59), and a housing (52) for temporarily receiving said second end of said flexible pipe, said lateral fluid inflow and said second end being adapted for automatic connection.

6. An installation according to claim 5, wherein said re-entry structure includes an hydraulic motor (53) for driving said drum in a direction for winding said flexible pipe onto said drum, and a third inflow funnel (54) connected (56) internally to said hydraulic motor and for receiving externally a handling fitting (66).

* * * * *